US006164393A

United States Patent [19]

Bakke

[11] Patent Number: 6,164,393

[45] Date of Patent: Dec. 26, 2000

[54] IMPACT TOOL

[75] Inventor: Stig Bakke, Åigård, Norway

[73] Assignee: Bakke Technology AS, Algard, Norway

[21] Appl. No.: 09/297,444

[22] PCT Filed: Oct. 27, 1997

[86] PCT No.: PCT/NO97/00281

§ 371 Date: Apr. 30, 1999

§ 102(e) Date: Apr. 30, 1999

[87] PCT Pub. No.: WO98/19041

PCT Pub. Date: May 7, 1998

[30] Foreign Application Priority Data

Oct. 30, 1996 [NO] Norway ..... 964600

[51] Int. Cl.[7] ..... E21B 4/14

[52] U.S. Cl. ..... 175/296; 175/305; 173/3; 173/177; 173/204

[58] Field of Search ..... 166/178; 175/293, 175/296, 297, 299, 305; 173/3, 19, 177, 204

[56] References Cited

U.S. PATENT DOCUMENTS

| | | | |
|---|---|---|---|
| 3,361,220 | 1/1968 | Brown | 175/237 |
| 3,379,261 | 4/1968 | Martini | 173/64 |
| 3,570,611 | 3/1971 | Riziuc et al. | 175/296 |
| 3,946,819 | 3/1976 | Hipp | 175/296 |
| 4,462,471 | 7/1984 | Hipp | 175/296 |
| 4,807,709 | 2/1989 | Flagout et al. | 175/296 |
| 5,232,060 | 8/1993 | Evans | 175/297 |
| 5,425,430 | 6/1995 | Roberts | 175/296 |
| 5,431,221 | 7/1995 | Roberts et al. | 175/321 X |

FOREIGN PATENT DOCUMENTS

| | | | |
|---|---|---|---|
| WO 94/18428 | 8/1994 | Norway | E21B 31/113 |

*Primary Examiner*—Roger Schoeppel
*Attorney, Agent, or Firm*—Head, Johnson and Kachigian

[57] ABSTRACT

A hydraulic impact tool for use in a well, such as an oil or gas well, comprising a movable hammer which is arranged to prestress a spring by means of a hydraulic piston (16) provided with a through channel (20), and in which a movable sealing body (22, 45) is arranged to enable closing of the channel (43), so that hydraulic force from fluid under pressure applied to the impact tool, may displace the piston (16) and the hammer and prestress the spring, and in which the sealing body (22) is arranged to follow the piston (16) into an end position for so to open the channel (20) for throughput, so that the hydraulic force acting on the piston (16, 41) ceases, and the prestressed spring is released and drives the hammer to strike, at the same time as the piston (16, 41) returns to initial piston, whereafter the process is repeated. The sealing body (22) is arranged to close said channel (20) when the sealing body is subjected to a predetemined frictional force from fluid flowing through the impact tool.

8 Claims, 8 Drawing Sheets

IMPACT TOOL

CROSS-REFERENCE TO RELATED APPLICATIONS

This application claims priority to U.K. Application No. 9800130.8 filed Jan. 6, 1998.

BACKGROUND OF THE INVENTION

The present invention relates to a hydraulic impact tool for use in a well, such as an oil or gas well, in particular to apply impact energy to a stuck object in order to get the object loose or break it.

Impact tools are often used in connection with operations, in which valves, measuring equipment and other equipment is to be anchored down in a well. An impact tool is attached as an extension of a pipe string, for example a drill string or coiled tubing, and equipment to be placed in the well is attached to the free end of the impact tool. The impact tool has a channel extending therethrough, so that fluid may pass. The equipment to be set in the well, may be provided with grippers, resilient lugs or other things which engage grooves or seat surfaces provided in the wall of the well. To ensure that the equipment does not become detached, it is often provided with a locking device which is activated through the shearing of a shear pin. In some cases the pipe string cannot transfer sufficient mechanical force to break the shear pins, and the shear pins may then be broken by means of an impact tool. Also, the impact tool is often provided purely as a precaution to make it possible to get the equipment loose in case it should get stuck.

In a hydraulic impact tool a movable, maybe sleeve-shaped hammer is biased towards a stop by means of an outer spring. A stroke is made by displacing the hammer from the stop, and then let the pre-tensioned spring drive the hammer back to the stop.

The hammer has a hydraulic piston arranged thereto, provided with a through passage in which a valve is provided. The valve is normally open, so that fluid may pass through the piston. By activating the valve and closing the through passage, the piston is displaced, and thereby the hammer is displaced from the stop when pressurized fluid is applied to it. At the same time the spring is further tensioned because of the movement of the hammer.

As the hammer reaches an end position, the valve is opened, so that fluid again may flow through the piston. The hydraulic force against the piston then quickly drops, and the spring drives the hammer (with the piston) back towards the stop. The valve is activated and then again closes the through passage in the piston, and the process is repeated.

SUMMARY OF THE INVENTION

It is known to use a spring, which can be prestressed from outside, to drive the hammer. Further, it is known to arrange said spring so, that it may be prestressed either through pulling at the pipe string in the direction away from the impact tool, or through pushing the pipe string in the direction towards the impact tool. Applied to an impact tool in a vertical position, the impact tool may then provide respectively upward and downward strokes, as the impact tool may comprise two separate valve mechanisms for upward and downward strokes respectively. Such impact tools are generally said to be double-acting. The magnitude of the impact force is changed by varying the prestressing of the spring.

It is common for said hydraulic valves activating the impact tool, to be influenced by the biasing of the spring. If the spring is in a neutral position, fluid may be pumped through the pipe string without the impact tool being activated. By applying a biasing to the spring, upwards or downwards, as mentioned, the impact tool is activated by a sealing body being brought to seal against through-put of fluid. This results in a pressure build-up, and the resulting hydraulic force displaces the hammer to a stroke start position.

In known impact tools the valve in the piston is activated, so that the through passage is closed by the hammer being carried to the start position towards the stop. Load of equipment hanging from the impact tool is often sufficient for exactly this to happen. This leads to fluid circulation through the pipe string being impossible as the impact tool is being inserted or withdrawn from the well without activating the impact tool. If circulation of long duration is required, said equipment may be damaged by the impact effect. The hydraulic parts of the impact tool, such as piston and valve elements, wear in operation, and will have to be replaced at regular intervals. In a long-lasting operation, in which fluid circulation is required, parts of the impact tool may be significantly worn before the impact tool will be put into operation, which may lead to a reduced impact effect and functional error.

The object of the invention is to provide a hydraulic impact tool where it is possible to circulate fluid, e.g. drill fluid, therethrough, without the impact tool being activated as the spring is being prestressed.

The object is reached through characteristics as stated in the following description and subsequent claims.

An impact tool according to the invention comprises hydraulic valve devices, which are arranged, in a manner known in itself, to close a through passage of a piston, as described, but in which the valve device only can be activated, when the flow rate of the fluid being circulated through the pipe string, exceeds a predetermined value.

The invention is described in the following through a non-limiting example of an embodiment of a double-acting impact tool, with reference to the accompanying drawings, in which:

DETAILED DESCRIPTION OF THE PREFERRED EMBODIMENT

Figure 1:
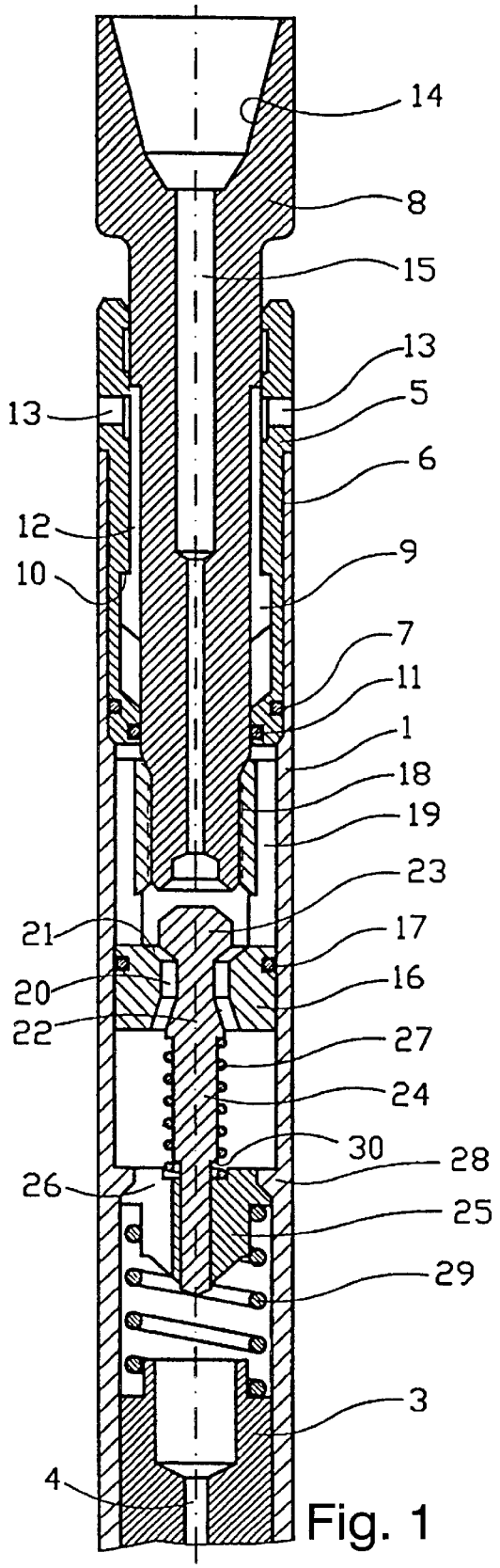
FIG. 1 shows a sectional side view of an upper and upward working part of an impact tool in initial position, referred to a vertical position of use.
Figure 1A:
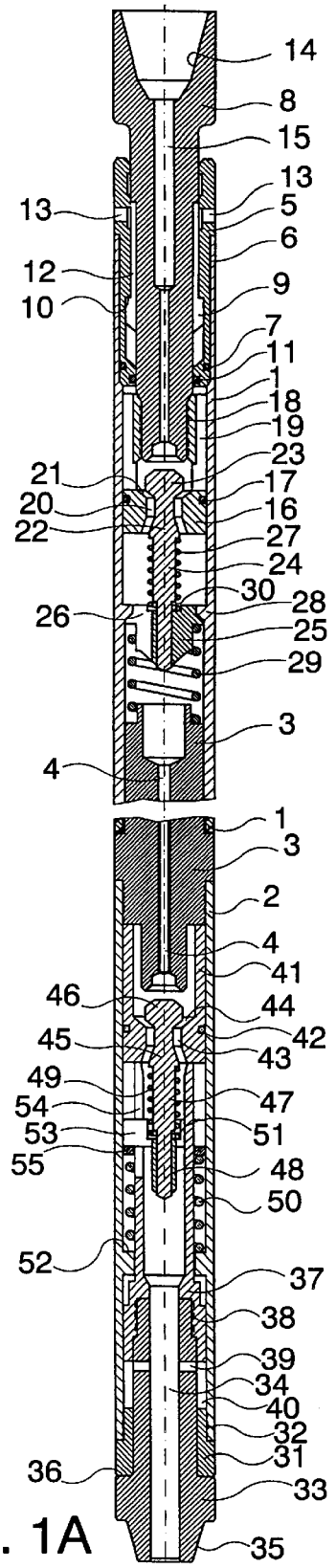
FIG. 1A represents a complete tool as shown in the invention.
Figure 4:
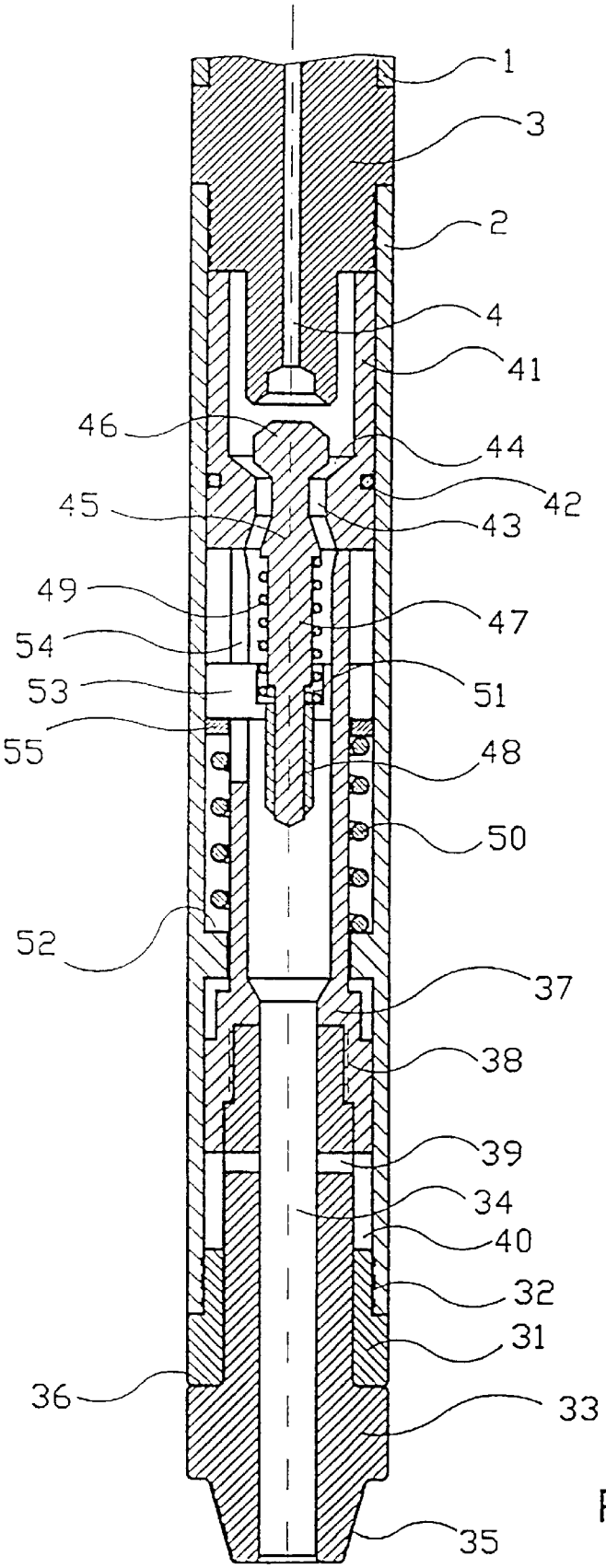
FIG. 4 is a sectional side view of a lower and downward working part of the impact tool in initial position.

In FIG. 1 the reference numeral 1, applied to a vertical position of use, indicates an upper tubular housing, which by its lower end is extended by a lower tubular housing 2 by means of an intermediate connection 3, which is provided with a through channel 4, see FIGS. 1 and 4.

The upper housing 1 is provided at its lower end with an internally threaded portion which engages complementary external threads at upper end of the connection 3. Sealing means, not shown, are provided, so that a pressure-tight connection is formed between the upper housing 1 and the connection 3.

The lower housing 2 is provided at its upper end with an internally threaded portion, which engages complementary threads at the lower end of the connection 3, and sealing means, not shown, are provided, so that a pressure-tight connection is formed between the connection 3 and the lower housing 2. The upper and the lower housings 1, 2 may thus be threadingly connected to a respective end of the connection 3, to form a continuous housing for the impact tool.

Fluid may pass from the upper housing 1 into the lower housing 2 through channel 4 of the connection 3.

The upper housing 1 is extended at its upper end by an upper end sleeve 5 which is screwed into the upper housing 1, the upper housing 1 being provided with an internally threaded portion 6 which engages complementary external threads on the end sleeve 5. Between the upper housing 1 and the upper end sleeve 5 is provided a first sealing 7.

The upper end sleeve 5 encloses an upper end piece 8 projecting through both ends of the end sleeve 5, and arranged so as to permit axial displacement thereof within the sleeve 5. The displaceable end piece 8 constitutes an upward acting hammer of the impact tool, and the end piece 8 is provided with an external impact ring 9 which is arranged to abut an internal shoulder 10 of the end sleeve 5. A second seal 11 at the lower end of the upper end sleeve 5 slidingly seals against the end piece 8 below the impact ring 9. Thus, in the end sleeve 5, between the seal 11 and the shoulder 10, is formed a portion of larger inner diameter than in. the rest of the end sleeve 5. To allow the end piece 8 to be mounted in the end sleeve 5, the end sleeve 5 must be divided. A skilled person will be able to suitably divide the end sleeve 5 in several ways. Division into two pieces in a plane through the main axis of the end sleeve 5 has proved to work well. Division of the upper end sleeve 5 is not shown. Externally, above the impact ring 9, the end piece 8 is provided with notches which cut through the impact ring 9, so that fluid may pass from below the impact ring 9 to above, further upward between the end piece 8 and the end sleeve 5, further out of the inpact tool through ports 13 at the upper end of the end sleeve 5.

In a known manner, the upper end piece 8 is provided at its upper end with an internally tapered threaded portion 14 for connection to a not shown pipe string, which is provided, in a known manner, with a not shown spring device arranged to be prestressed and provide impact energy for the impact tool.

The upper end piece 8 is provided with a bore 15 to allow a fluid, typically a drill fluid, to flow through the end piece 8 into the upper housing 1.

To the lower end of the upper end sleeve 5 is attached an upper piston 16 which slidingly seals outwards against the upper housing 1 by means of a seal 17. The piston 16 is provided with an internally threaded portion 18 which engages complementary external threads at the lower end portion of the upper end piece 8. In the upper piston 16, above the seal 17, are provided several grooves 19, so that fluid may flow through the bore 15 of the upper end piece 8, out through said grooves 19. The pressure of the fluid may thus affect the whole surface area of the piston 16 above the seal 17.

Figure 8:
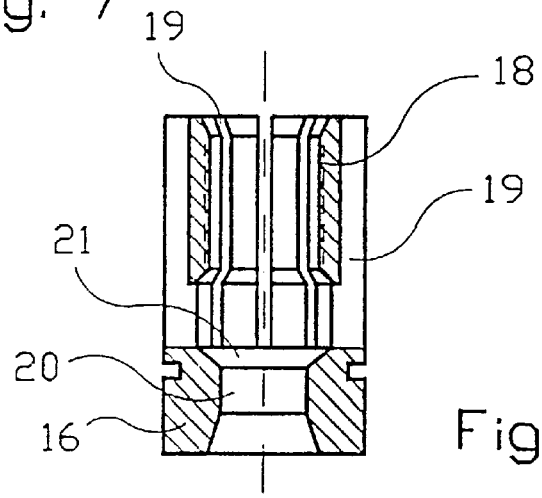
FIG. 8 is a sectional side view of an upper piston.
Figure 9:
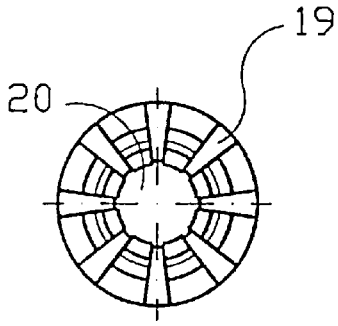
FIG. 9 is a top plan view of the piston in FIG. 8.

In the piston 16 is provided a through channel 20, which at its upper outlet is provided with a seat surface 21, see FIGS. 1, 8 and 9.

An upper sealing body 22 comprises a stem which is provided, at its upper end, with a head 23. The head 23 is arranged to seal against the seat surface 21 of the piston 16. The stem 24 of the sealing body 22 extends within the channel 20 of the piston 16, through the piston 16 to somewhat below the underside of the piston 16.

Figure 10:
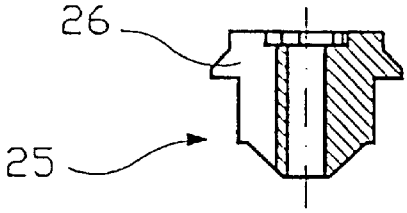
FIG. 10 is a sectional side view of an upper slide.
Figure 11:
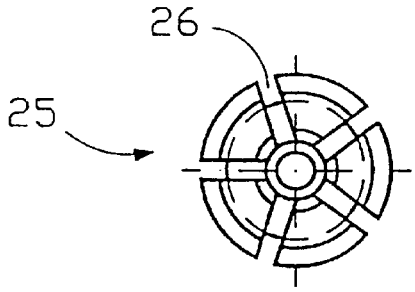
FIG. 11 is a top plan view of the slide in FIG. 10.

The stem 24 of the sealing body 22 is supported axially displaceable in an upper slide 25, which may be moved axially in the upper housing 1. The upper slide 25 is provided with longitudinal external grooves 26, so that fluid may pass on the outside of the slide 25, see FIGS. 10 and 11.

A spring 27, acting between the sealing body 22 and the slide 25, lifts the sealing body 22 to an upper end position, to create a clearance between the head 23 and the seat surface 21.

Fluid may flow through the bore 15 of the upper end piece 8, into the piston 16 and through the channel 20, there being a clearance between the channel 20 and the stem 24 of the sealing body 22, and further, through the grooves 26, past the upper slide 25.

The upper slide 25 is kept in an upper end position against an internal shoulder 28 of the upper housing 1 by an upper slide spring 29 acting between the upper slide 25 and the upper end of the connection 3. The stem 24 of the sealing body 22 is provided with a collar 30 arranged to abut the upper side of the slide 25.

In the lower housing 2 are provided parts complementary to those mentioned above. The parts in the lower housing 2 are active in downward strokes.

At the lower end of the lower housing 2 is provided a lower end sleeve 31, see FIG. 4. The lower housing 2 is provided at its lower end with an internally threaded portion 32 which engages complementary external threads on the lower end sleeve 31. Sealing means, which are not shown, provide a pressure tight connection between the lower housing 2 and the lower end sleeve 31.

The lower end sleeve 31 encloses an axially displaceable, tubular lower end piece 33 with a bore 34 extending therethrough, so that fluid may flow from the lower housing 2 out through the lower end piece 33. The lower end piece 33 is provided at its lower end with external, tapering threads 35, which are complementary to the internal tapering threads 14 of the upper end piece 8, for connecting to a tool, pipe string or other object.

The lower end piece 33 is provided with an external annular impact surface 36. In downward strokes, the lower end piece 33 is stationary, while the other parts of the impact tool is driven in a downward direction, so that the lower end of the lower end sleeve 31 hits the impact surface 36. This will be explained in more detail later.

To the upper end of the lower end piece 33 is attached a sleeve-shaped body 37, which is provided at its lower end with an internally threaded portion 38 engaging complementary external threads at the upper end of the lower end piece 33. Side ports 39 in the lower end piece 33 connect the bore 34 to an annulus 40 between the lower housing 2 and the lower end piece 33. The annulus 40 is defined in the longitudinal direction by the lower end sleeve 31 and the sleeve-shaped body 37. When the lower end piece 33 is displaced in relation to the lower housing 2 and the lower end sleeve 31, the length of the annulus 40 will change.

A lower piston 41 rests by its underside on an upper end of the sleeve-shaped body 37. Externally, the lower piston 41 is provided with a fourth seal 42 which slidingly seals outwards against the lower housing 2. In the same manner as the upper piston 16, the lower piston 41 is provided with a through channel 43 which is provided with a seat surface 44 at its upper outlet.

A lower sealing body 45 comprises, in the same way as the upper sealing body 22, a head 46 arranged to seal against the seat surface 44 of the lower piston 41. Likewise, the lower sealing body 45 comprises a stem 47 which extends within the channel 43 through the lower piston to a lower slide 48, in which the sealing body 45 is displaceably supported. The lower slide 48 may be moved axially within the lower housing 2. A lower spring 49 acting between the lower sealing body 45 and the lower slide 48, retains the sealing body 45 in an upper position, so that there is a clearance between the head 46 and the seat surface 44.

The stem 47 of the lower sealing body 45 is provided with a collar 51 which is arranged to abut the upper side of the slide 48. As the upper slide 25, the lower slide 48 is correspondingly provided with longitudinal external grooves, so that fluid may pass on the outside of the slide 48.

A lower slide spring 50 provided in the annulus between the sleeve-shaped body 37 and the lower housing 2, acts between the upper side of an internal collar 52 of the housing 2, and the underside of the lower slide 48. The lower slide spring 50 retains the lower slide 48 in an upper starting position.

Figure 12:
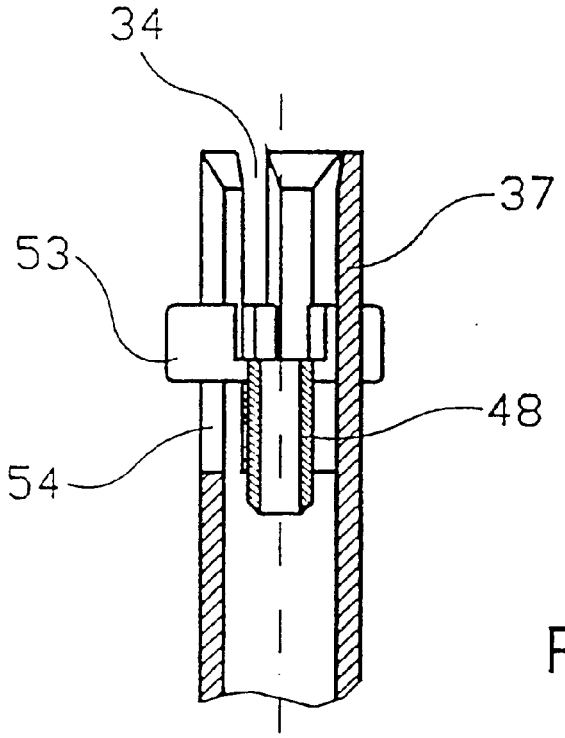
FIG. 12 is a sectional side view of a sleeve-shaped body enclosing a lower slide.
Figure 13:
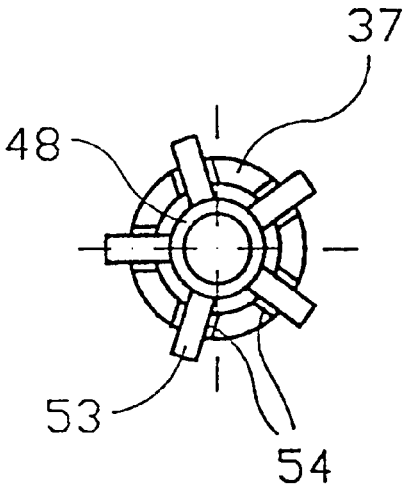
FIG. 13 is a top view of the sleeve-shaped body and the slide in FIG. 12.

As mentioned, the lower slide 48 is provided with external grooves, so that the body material between said grooves forms radial fins 53. The lower slide 48 is enclosed by the upper part of the sleeve-shaped body 37. The wall of said upper part of the sleeve-shaped body 37 is provided with slots or grooves 54, through which the fins 53 of the slide 48 project, see FIGS. 12 and 13. The grooves 54 are of sufficient length to enable displacement of the slide 48 over a downward distance within the sleeve-shaped body 37.

The lower slide spring 50 acts against the underside of the fins 53, through a retaining ring 55, see FIG. 4.

Figure 2:
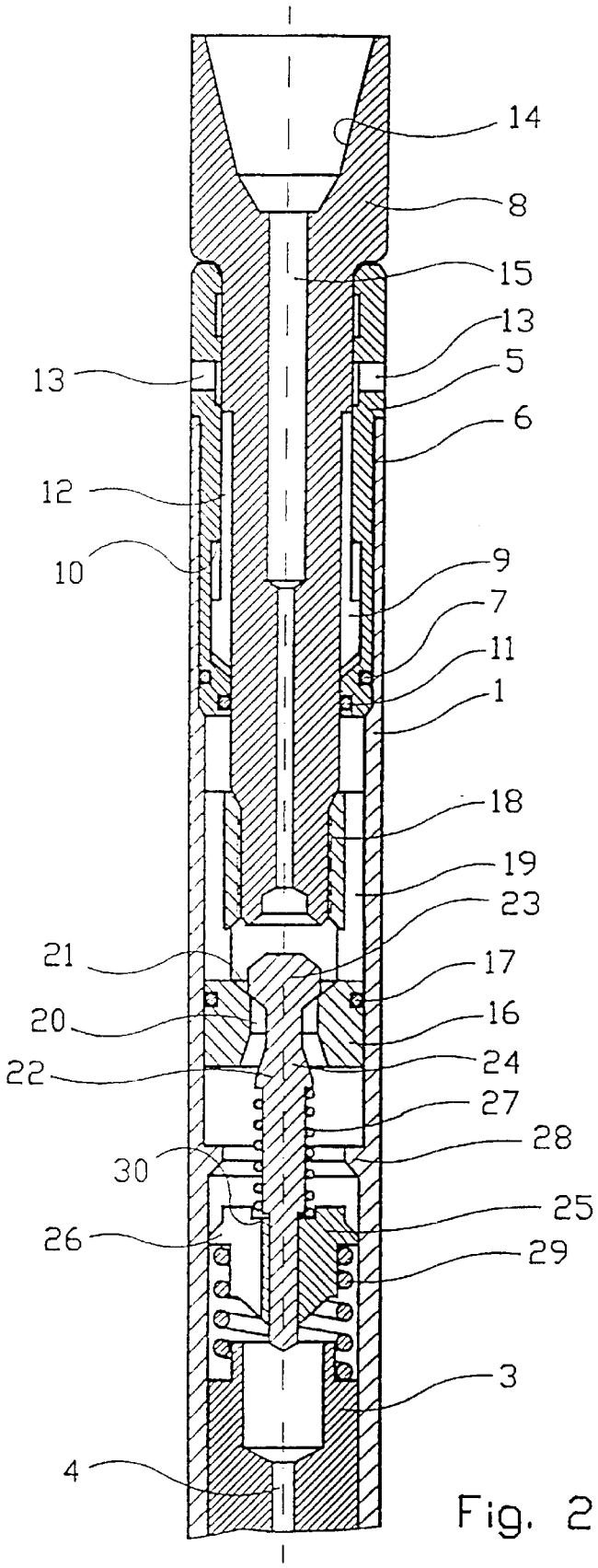
FIG. 2 shows the upward working part ready to strike.
Figure 3:
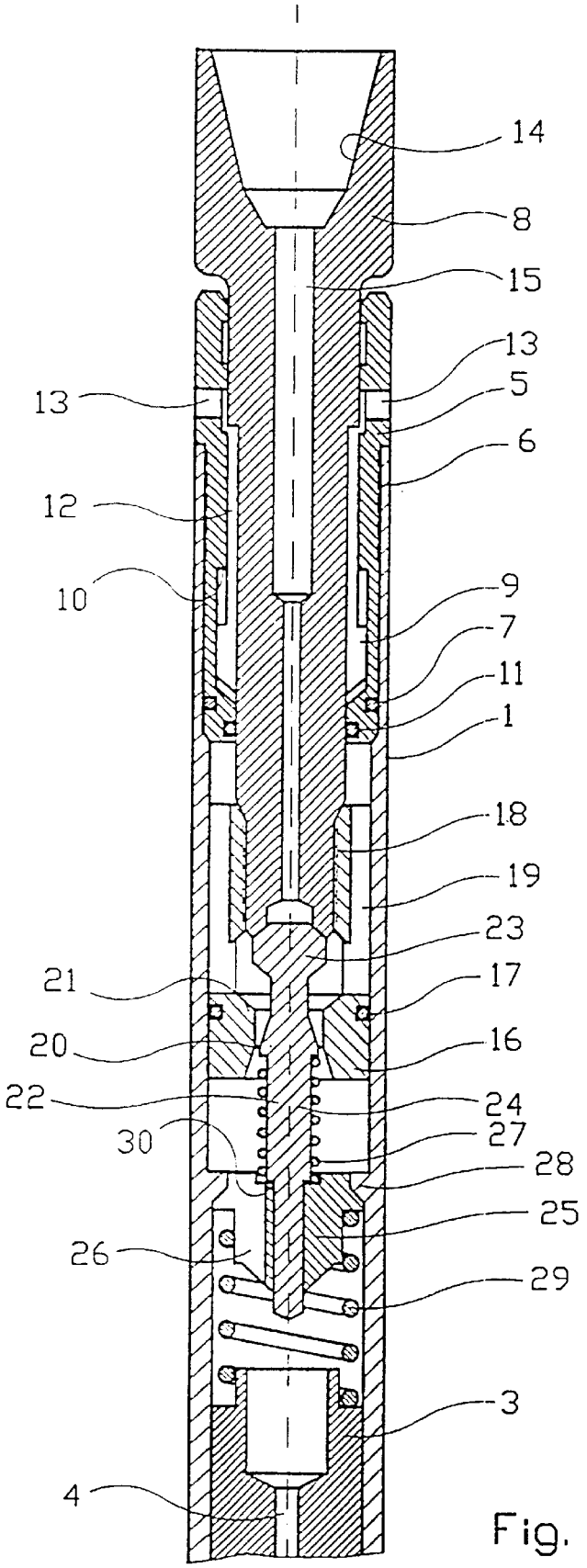
FIG. 3 shows the upward working part ready to strike, the striking movement having started.

The operation of the impact tool will be described in the following, and first upward strokes will be described with reference to FIGS. 1–3.

In the initial position, as shown in FIG. 1, the upper end piece 8 is retained by an upward acting force from a not shown prestressed spring, in an initial position, in which the impact ring 9 bears against the shoulder 10.

Fluid is circulated from the surface through the bore 15 of the upper end piece, past the head 23 of the upper sealing body 22, through the channel 20 of the upper piston 16, past the upper slide 25 to the connection 3. The fluid passes the connection 3 through the channel 4 to the lower housing 2, through the lower piston 41, past the lower slide, out through the bore 34 of the lower end piece 33, see FIG. 4. The impact tool is idle and allows fluid to pass.

To activate the impact tool, the flow rate of the fluid is increased, so that the friction of the fluid against the upper sealing body 22 results in a downward force which displaces the sealing body 22 against the force of the spring 27, until the head 23 of the sealing body 22 lands on the seat surface 21 of the upper piston 16. The head 23 thus closes the channel 20 for through-put of fluid. The now tight piston 16 is driven downwards within the upper housing 1 by the force, applied by the fluid pressure to the piston 16 and the head 23 of the sealing body 22. The piston 16 pulls the upper end piece 8 downward.

The collar 30 of the stem 24 of the sealing body 22 lands on the upper slide 25. The force of the hydraulic pressure acting on the upper side of the head 23 of the sealing body 22, thus drives the upper slide 25 downward against the force of the upper slide spring 29, as shown in FIG. 2.

The motion of the slide 25, tensions the slide spring 29, so that the slide spring 29 effects a constantly increasing upward force against the slide 25 and the sealing body 22.

If the force of the slide spring 29 exceeds the hydraulic force acting on the head 23 of the sealing body 22, the slide spring will lift the head 23 clear of the seat surface 21 in the piston 16. Alternatively, the slide 25 will reach a lower end position in abutting the connection 3, or by the slide spring 29 not being further compressible. The hydraulic force acting on the piston 16, will force the piston 16 further downwards, and a clearance is created between the head 23 of the sealing body 22 and the seat surface 21 of the piston 16.

Fluid will immediately pass through the upper piston 16, resulting in a quick fluid pressure drop above the piston 16. The hydraulic force against the sealing body 22 and the piston 16 is correspondingly reduced. The slide spring 29 drives the slide 25 and the sealing body 22 back towards their initial positions, see FIG. 3.

The force of said, not shown, prestressed spring pulls the upper end piece 8 and the piston 16 towards the initial position, and the impact ring 9 hits the internal shoulder 10 of the upper end sleeve 5, whereby an upward stroke is created. Friction of the flowing fluid will again carry the head of the sealing body 22 into abutment against the seat surface 21 of the piston 16, and the process is repeated.

To achieve downward strokes, a downward spring force from a prestressed spring, not shown, is applied to the tool. The upper end piece 8 and the piston 16 are then pushed down into the upper housing 1, and the sealing body 22 cannot close the channel 20 of the upper piston 16, even if the sealing body 22 is displaced into the lower end position. The upper part of the impact tool, i.e. the components located in the upper housing 1, are idle in downward strokes.

Downward strokes will be described with reference to FIGS. 4–6. In the same way as for upward strokes, fluid may pass, even if the impact tool is subjected to a downward force from a prestressed spring. To activate the impact tool, the operator increases the flow rate of fluid flowing through the impact tool, as already described.

Frictional force acting against the lower sealing body 45, displaces the sealing body 45 against the force of the spring 49. The head 46 lands on the seat surface 44 in the lower piston 41 and closes the channel 43 for through-put.

The fluid pressure acting on the upper side of the lower piston 41, will lift the lower housing 2, with the lower end sleeve 31 and the rest of the impact tool, in relation to the lower end piece 33, as the lower piston 41 rests on the upper end of the sleeve-shaped body 37.

Figure 5:
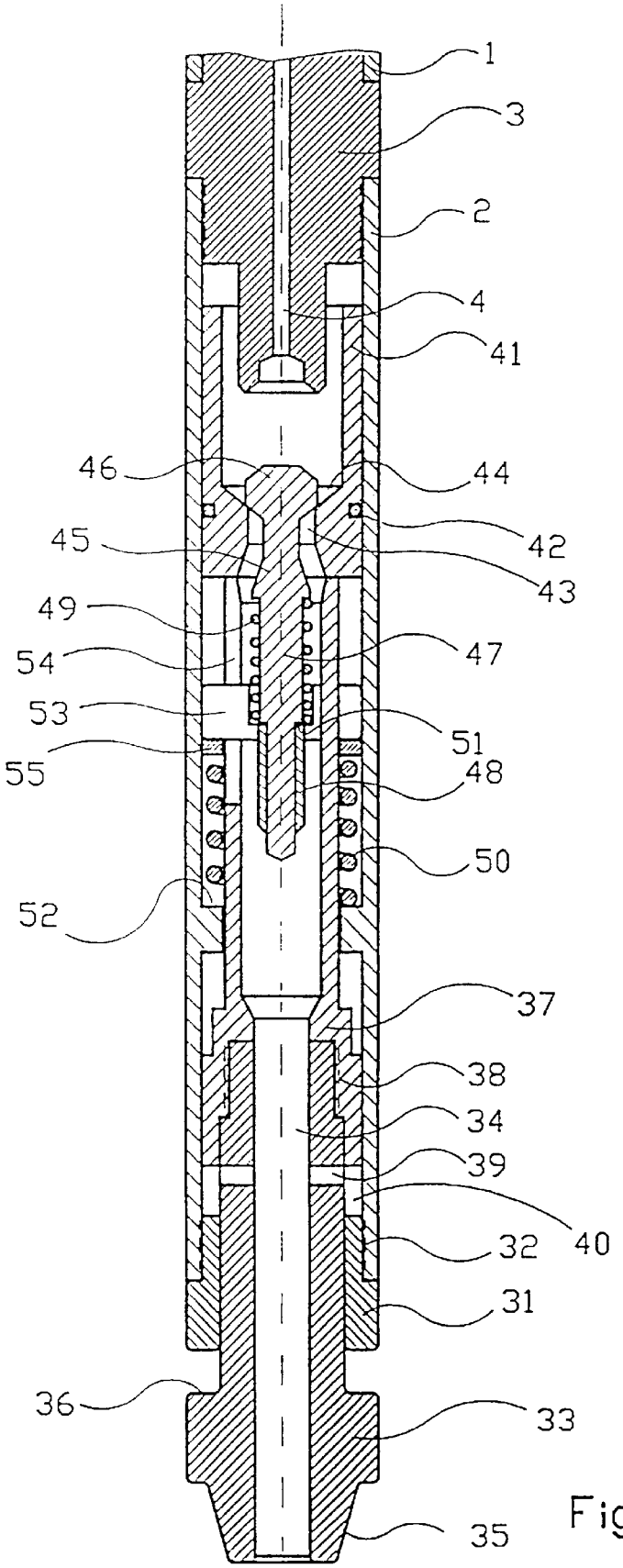
FIG. 5 shows the downward working part ready to strike.
Figure 6:
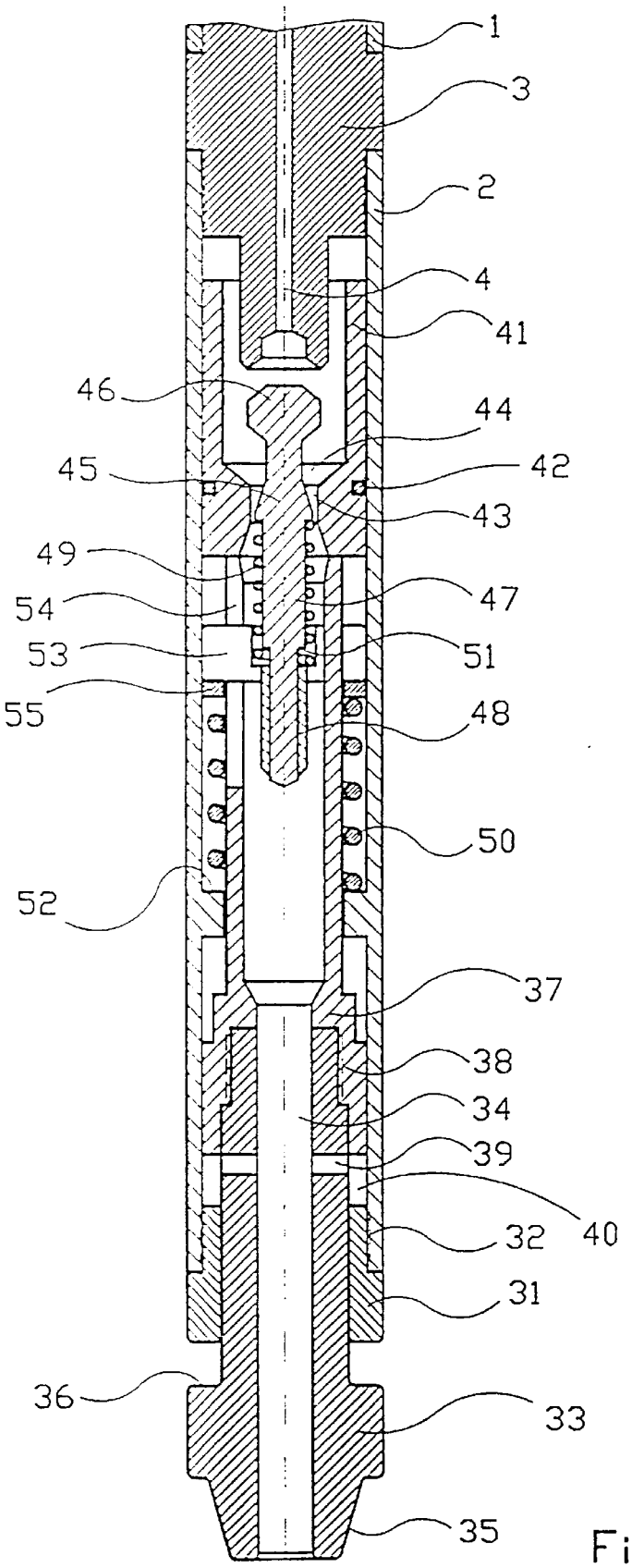
FIG. 6 shows the downward working part ready to strike, the striking movement having started.
Figure 7:
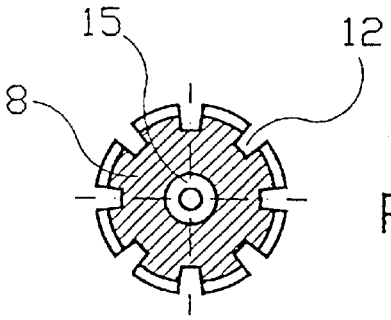
FIG. 7 is a sectional top plan view of an upper end piece.

As the lower housing 2 is being lifted, the lower slide spring 50 is compressed, see FIG. 5, in a manner corresponding to that explained for the upper slide spring 29. The lower slide 48 abuts the collar 51 of the lower sealing body 45, and the force of the slide spring 50 increases as the lower housing 2 is being lifted.

The upward force of the lower slide spring 50 against the sealing body 45 will exceed the downward force of the hydraulic pressure acting on the upper side of the head 46 of the sealing body 45. Alternatively, the fins 53 of the lower slide will land on the bottom of the grooves 54. Continued supply of pressurized fluid and thereby lifting of the lower housing 2 will result in the lower sealing body 45 also being lifted. Then a clearance is created between the head 46 and the seat surface 44. Fluid will immediately flow through the lower piston 41, and the fluid pressure on the upper side of the piston 41 quickly drops. The lower slide spring 50 drives the lower slide 48 and the sealing body 45 upward and back towards initial position. The impact tool, apart from the lower end piece 33 which is stationary, is driven downward by the prestressed spring force, so that the lower surface of the lower end sleeve 31 strikes against the annular impact surface 36 of the lower end piece 33, whereby a downward stroke is achieved.

If the flow rate is sufficiently great, fluid flowing past the lower sealing body 45 will again displace the sealing body 45 so that the head 46 bears against the seat surface 44 in the lower piston 41, and the process is repeated. While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A hydraulic impact tool for use in a well having a control valve (22, 20; 45, 43) adapted to be influenced through an increase of the fluid flow rate, said impact tool adapted to supply impact energy to an object stuck in the well in order to loosen the object or to crush it, and which comprises:

an elongate tubular housing (1) for flow of fluid therethrough in the longitudinal direction and for, in a longitudinal upstream portion thereof, accommodating an end piece (8) having an axial through-going fluid channel and carrying the impact hammer (9) as well as being connected to a hydraulic, axially displaceable piston (16; 41) having an axially through-going channel (20; 43), and wherein an axially displaceable sealing body (22; 45) is adapted to close or expose, respectively, one orifice of the piston channel (20; 43), so that hydraulic power developed by fluid under pressure supplied to the impact tool in the closed position of the piston channel (20; 43) can displace the piston (16; 41) and the hammer (9) as well as tension a spring assigned to the hammer (9), said spring being released in tensioned condition when said piston channel orifice is exposed upon the following axial displacement of the sealing body (22; 45), to move the hammer (9) to bear against a stop (10) in order to impact, simultaneously as the piston (16; 41) returns to the inoperative position of readiness, wherein said sealing body (22; 45) has an elongate, axially extending stem which, upstreamly, terminates into a head (23; 46) formed with a downstreamly conical sealing face (23') for resting sealingly against a complementarily shaped, upstream seat face (21; 44) in said piston channel orifice, the axially extending stem passing with clearance through the piston channel (20; 43) upon closed as well as open piston channel (20; 43) and, with its downstream portion, is axially displaceably mounted in an axially movable slide (25; 48) formed with longitudinal, through-going fluid passage grooves (26), a spring (27; 49) being tensioned between the sealing body (22; 45) and the slide (25; 48), said spring attempting to direct the sealing body (22; 45) toward an end position where the conical sealing face (23') on the head (23; 46) thereof does not bear sealingly against the seat face (21; 44) of the piston channel (20; 43) at said orifice, the slide (25; 48) having a spring (29; 50) forcing the slide (25; 48) in a position in which the sealing body (22; 45) exposes the piston channel (20; 43) so that, when the fluid flow rate through the impact tool is increased sufficiently, the sealing body (22; 45) is moved to rest sealingly against the piston (16; 41) in order to initiate impact action.

2. A hydraulic impact tool as defined in claim 1, wherein the head (23; 46) of the sealing body (22; 45), besides its conical sealing face (23') facing in the downstream direction and periodically cooperating sealingly/closingly with the seat face (21) at the upstream orifice of the piston channel (20; 43), is formed with an oppositely directed, conical sealing face (23") adapted to cooperate with a complementary seat face (15') formed at the downstream orifice of said axially through-going channel (15) through said hammer-carrying end piece (8).

3. A hydraulic impact tool as defined in claim 1 wherein the piston channel (20; 43), downstream of the seat face (21; 44) thereof, has a substantially cylindrical, longitudinal portion passing into a downstream portion becoming trumpet-like wider in a direction away from the piston channel orifice exhibiting the seat face (21; 44).

4. A hydraulic impact tool as defined in claim 1, wherein internally within the elongate tubular housing (1), a rest (10) has been disposed for the hammer (9) in the inoperative position thereof and a shoulder (28) for the slice (25; 48) in its upstream position, the sealing body (22; 45) being provided with a shoulder (30: 51) adapted to come to bear against the upstream end of the slide (25; 48).

5. A hydraulic impact tool as set forth in claim 1 wherein said impact tool is mountable as an extension of a pipe string.

6. A hydraulic impact tool as set forth in claim 2 wherein the piston channel (20; 43), downstream of the seat face (21; 44) thereof, has a substantially cylindrical, longitudinal portion passing into a downstream portion becoming trumpet-like wider in a direction away from the piston channel orifice exhibiting the seat face (21; 44).

7. A hydraulic impact tool as set forth in claim 2 wherein internally within the elongate tubular housing (1), a rest (10) has been disposed for the hammer (9) in the inoperative position thereof and a shoulder (28) for the slice (25; 48) in its upstream position, the sealing body (22; 45) being provided with a shoulder (30: 51) adapted to come to bear against the upstream end of the slide (25; 48).

8. A hydraulic impact tool as set forth in claim 3 wherein internally within the elongate tubular housing (1), a rest (10) has been disposed for the hammer (9) in the inoperative position thereof and a shoulder (28) for the slice (25; 48) in its upstream position, the sealing body (22; 45) being provided with a shoulder (30: 51) adapted to come to bear against the upstream end of the slide (25; 48).

* * * * *